US007328656B2

(12) United States Patent
Jeurink

(10) Patent No.: US 7,328,656 B2
(45) Date of Patent: Feb. 12, 2008

(54) PRINTING DEVICE

(75) Inventor: Wilfried Jeurink, Nordhorn (DE)

(73) Assignee: WINK Stanzwerkzeuge GmbH & Co. KG, Neuenhaus (DE)

( * ) Notice: Subject to any disclaimer, the term of this patent is extended or adjusted under 35 U.S.C. 154(b) by 297 days.

(21) Appl. No.: 10/905,613

(22) Filed: Jan. 13, 2005

(65) Prior Publication Data

US 2005/0155505 A1 Jul. 21, 2005

(30) Foreign Application Priority Data

Jan. 17, 2004 (DE) ..... 202004000683.9

(51) Int. Cl.
*B41F 27/02* (2006.01)

(52) U.S. Cl. ..... 101/389.1; 101/217; 101/375

(58) Field of Classification Search ..... 101/389.1; *B41F 27/02*

See application file for complete search history.

(56) References Cited

U.S. PATENT DOCUMENTS 2,952,205 A * 9/1960 Dunwoodie ..... 101/378
3,885,498 A * 5/1975 Jenkins ..... 101/389.1
6,397,747 B1 * 6/2002 McEachern ..... 101/389.1
6,745,692 B2 * 6/2004 Lorig et al. ..... 101/375

FOREIGN PATENT DOCUMENTS

JP 55015816 A * 2/1980
JP 55032633 A * 3/1980

* cited by examiner

*Primary Examiner*—Leslie J. Evanisko
(74) *Attorney, Agent, or Firm*—Gudrun E. Huckett

(57) ABSTRACT

A printing device has a support roll and a sleeve having at least one sleeve element and detachably mounted on the support roll, wherein the sleeve, when mounted on the support roll, surrounds at least partially the support roll. At least one printing plate is adapted to be detachably mounted on the sleeve. A securing device for securing the at least one printing plate on the sleeve is provided, wherein the securing device has at least one magnetic element and a ferromagnetic material interacting with the at least one magnetic element.

6 Claims, 6 Drawing Sheets

PRINTING DEVICE

BACKGROUND OF THE INVENTION

The invention relates to a printing device, in particular, for flexographic printing (flexo printing), comprising a support roll, a sleeve and at least one printing plate to be secured on the sleeve, wherein the sleeve comprised of at least one sleeve element is mountable on the support roll and surrounds the support roll at least partially in the mounted state.

During printing, the support roll and the sleeve form a unitary body of rotation with the sleeve, however, being exchangeable. The sleeve can be first provided with the printing plate and then pushed onto the support roll such that the sleeve is widened at its inner side by compressed air exiting from the support roll and is slidably movable on an air cushion to the desired location (pneumatic threading) before it is seated elastically on the support roll when the compressed air is switched off. Other known detachable securing means for sleeve and support roll provide for positive-locking engagement in the direction of rotation, for example, by means of a tongue and groove connection. In this way, changeover/makeready times for printing can be shortened, different outer sleeve diameters can be provided, and it is possible to axially sequentially position several sleeves on the support roll.

For printing films, paper sheets, or paper webs, at present so-called water-based printing inks, UV printing inks, and solvent printing inks are used, i.e., printing inks that upon removal of water, by irradiation with UV light, or by removal of a (chemical) solvent will dry or set (cure). In this connection, in particular, in the case of flexo printing, a multi-roll system that is referred to as a printing group is used for each printing ink. The outer sides of the usually cylindrical printing group in contact with the material to be printed on are, for example, in the form of printing plates having a flexible bottom and mounted on a sleeve of the printing group. In order for the printing plates not to become detached from the fast-rotating sleeve of the printing or support rolls of the printing group during the printing process, they can be attached in different ways on the sleeves. For this purpose, double-sided adhesive mounting tapes or also foam adhesives are used, for example.

Instead of using adhesive mounting tapes or foam adhesives for attaching printing plates on the sleeve, it is also possible to attach a layer of polymers fixedly on the outer side of the sleeve. After curing of the polymer layer, it is ground to be round and subsequently is laser-engraved in accordance with the printing image to be produced. Both technologies have the disadvantage that they are time-consuming and cost-intensive.

Because of a continuously increasing demand for printing devices, in particular, flexo printing machines, with an ever increasing number of printing groups, there is the need to simplify the application of a printing plate (image to be printed) on a sleeve.

SUMMARY OF THE INVENTION

It s an object of the present invention to provide a sleeve for a printing device, in particular, for flexo printing, with which the mounting of the printing plate (image to be printed) on the sleeve is improved.

In accordance with the present invention, this is achieved by a sleeve for a printing device wherein at least one magnetic element is provided for attachment of the printing plate on the sleeve. In particular, the sleeve has securing means for detachably securing on the sleeve at least one printing plate that comprises a ferromagnetic material or has at least one magnetic element, wherein the securing means comprises at least one magnetic element for interacting with the ferromagnetic material of the at least one printing plate or the securing means is a ferromagnetic material interacting with the at least one magnetic element of the printing plate. The printing plate is magnetically secured and can be mounted quickly. Printing plates attached in this way can be removed or newly positioned in a simple way. The use of double-sided adhesive tape or, for example, foam adhesives is obsolete, and this leads to time savings and reduced costs in regard to mounting of the printing plate.

The sleeves therefore advantageously adapt mounting and securing techniques as they are already used in regard to punching sheets that are not secured on sleeves but are secured on magnetic cylinders having permanent magnets that are recessed circumferentially in the cylinder and produce punctures or imprints, in particular, in paper or foils.

In an advantageous configuration of the invention, parts of the sleeve are configured to be magnetizeable so that the magnetic element is formed preferably by an outer layer of the sleeve. It is within the scope of the invention to employ different types of magnetization for configuring a magnetic layer of the sleeve. For example, it is conceivable that the sleeve has an outer layer comprised of a magnetic film or foil or of a magnetizeable material that can be magnetized by the action of a magnet.

Preferably, the magnetic element is formed by permanent magnets incorporated into the sleeve. These permanent magnet configurations of the sleeve according to the invention have in common that, when the bottom of the printing plate or of the support of the printing image is configured to be at least partially ferromagnetic, a magnetic field can be formed between it and the sleeve.

In order to improve the attachment or mounting of a printing image on the sleeve, another embodiment of the sleeve according to the invention is provided with at least one positioning device for positioning the individual elements of the printing device. By means of, for example, alignment pins, positioning bushings, stop edges or stop grooves, the individual elements of the printing device, for example, the support roll or cylinder, the individual layers of the sleeve or even the printing plate can be checked manually or by means of a machine-operated device with regard to their proper arrangement and can be sequentially arranged with precise fit. A visual checking of the proper position by means of, for example, laser-assisted measuring devices is also within the scope of the invention.

In regard to simpler printing devices, it is also conceivable that the sleeve and the support cylinder (roll) are configured as a unitary part so that an attachment of the sleeve on the support cylinder, to be performed otherwise by means of pneumatic threading or by means of a tongue and groove system, is now obsolete.

A printing plate for use in the printing device according to the invention is characterized in particular by a thin-walled, flexible, and ferromagnetic bottom. The bottom can be comprised, for example, of sheet steel and is a support for the printing layer that comes into contact with the printing material. Such bottoms of printing plates have the required resistance and load capacity for use even at high printing speeds.

DESCRIPTION OF THE PREFERRED EMBODIMENTS

Figure 1:
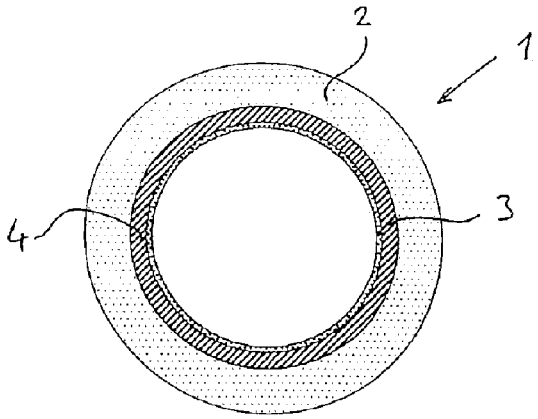
FIG. 1 is a cross-section of a sleeve according to the invention for a printing device.

A sleeve 1 for a printing device according to the invention in the embodiment illustrated in FIG. 1 has a shape-stable (dimensionally stable) outer layer 2. This layer 2 can be comprised of, for example, aluminum, steel, preferably stainless steel, or plastic material. An inwardly positioned molded fiber sleeve (hardboard sleeve) 3 and a plastomer layer 4, possibly forming an intermediate layer, provide expandable layers in order to mount the sleeve 1 by means of the pneumatic threading method with the aid of compressed air on a support roll or support cylinder, not illustrated in FIG. 1. For pneumatic threading, a inner jacket of the sleeve 1 is manufactured to have undersize relative to an outer jacket of a support roll 7 and is expanded by compressed air that is oriented radially outwardly away from the support roll 7 during mounting. Simultaneously, the sleeve floats on an air cushion and is easily movable. Once the sleeve 1 is positioned, for example, by means of a positioning system, at the correct location on the support roll 7, the compressed air is switched off and the sleeve is seated with slight undersize securely on the support roll 7.

Figure 2:
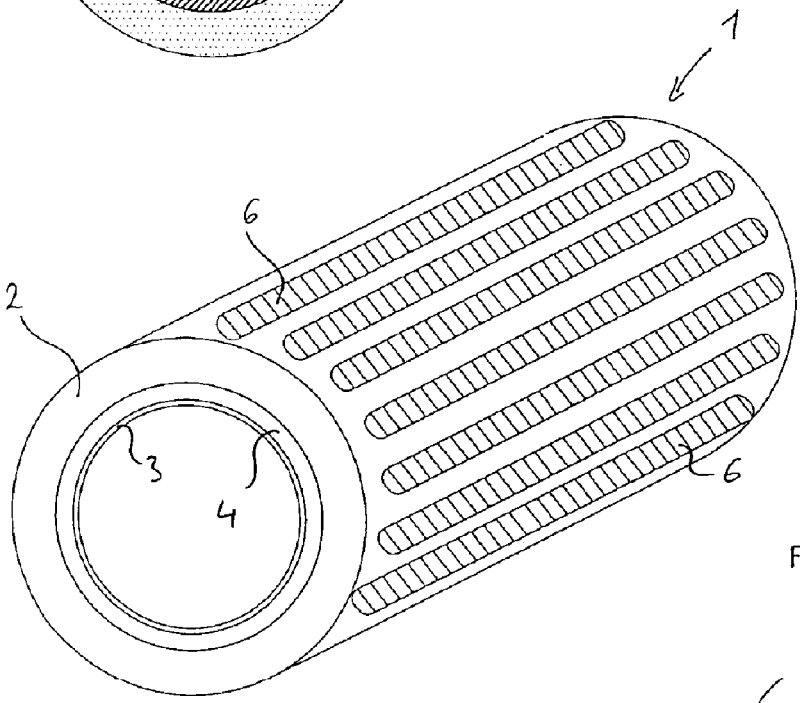
FIG. 2 is a perspective illustration of a sleeve for a printing device in accordance with the invention with axially arranged magnets.

The shape stable (dimensionally stable) outer layer 2 in this embodiment has a plurality of permanent magnets 6 that are recessed (or sunken) within the outer layer 2 of the sleeve 1 across the circumferential outer surface so as to be flush with the outer surface of the sleeve 1 (FIG. 2). Provided that the printing plate that is to be used is attached securely on the sleeve 1 by the arrangement of the permanent magnets 6 in the outer layer 2 of the sleeve 1, the magnet arrangement can have many different configurations, wherein manufacturing-technological considerations are taken into account for incorporating the magnets.

Figure 3:
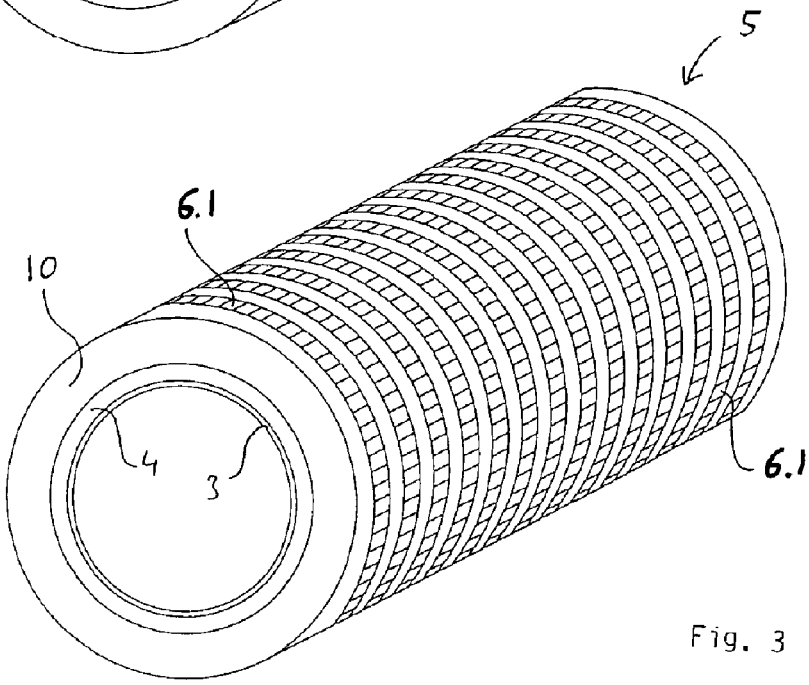
FIG. 3 shows a sleeve according to another embodiment for a printing device with magnets arranged in concentric strips.
Figure 4:
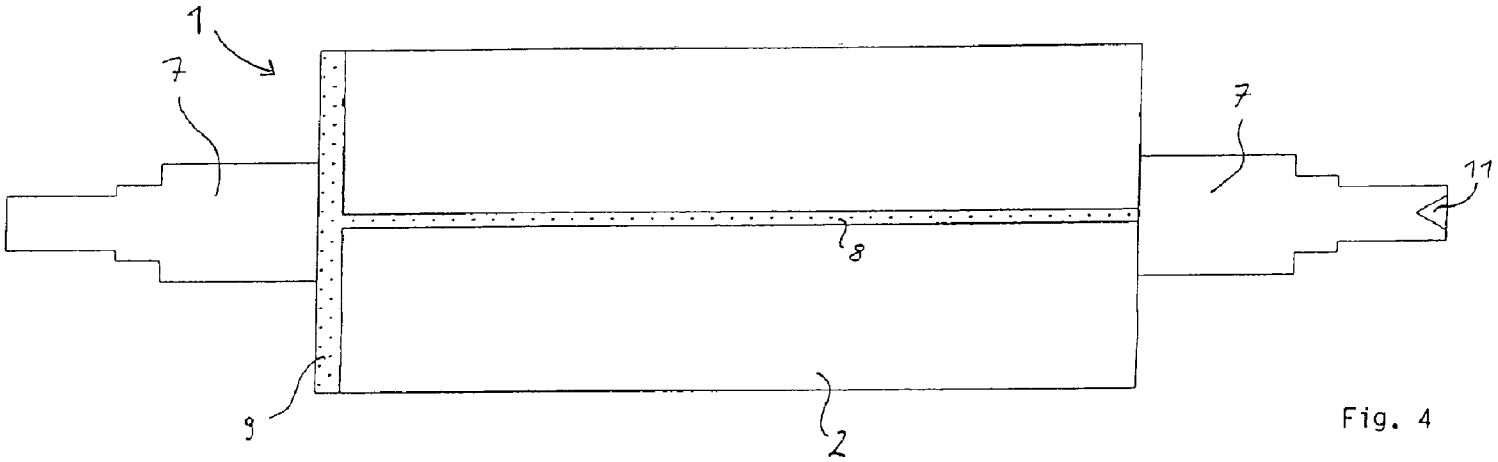
FIG. 4 is an illustration of a sleeve mounted on a support cylinder in accordance with the invention.
Figure 5:
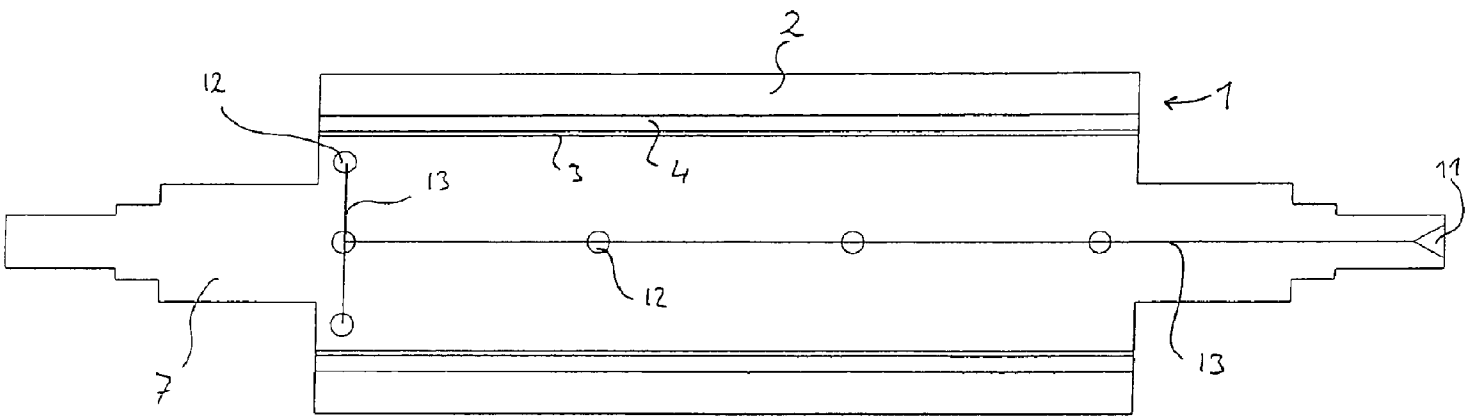
FIG. 5 is a longitudinal section of the sleeve and support cylinder illustrated in FIG. 4.

In contrast to the arrangement of the magnetic elements 6 in the configuration according to FIG. 2, the embodiment according to FIG. 3 has a sleeve with an outer layer 10 into which the magnets 6.1 are recessed and form cylindrical strips or rings. The inner layer 3 as well as the intermediate layer 4 are identical to the configuration of FIG. 2.

Figure 6:
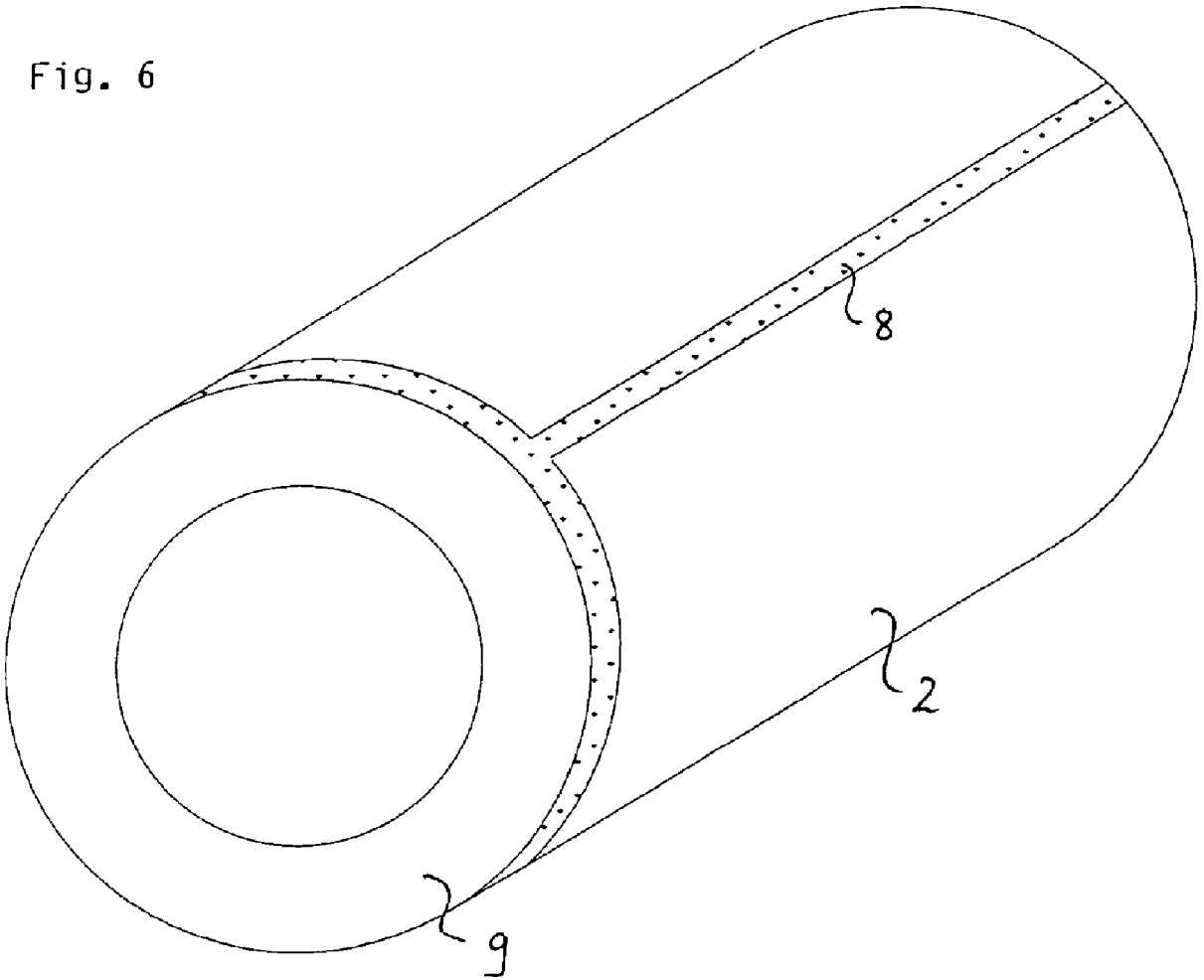
FIG. 6 shows a sleeve for a printing device in accordance with the invention with a sheet metal piece recessed within the outer wall of the sleeve so as to be flush with the outer surface.

Advantageously, the sleeve 1 mounted on the support roll 7 has an electrically conducting element 8 that is either recessed (sunken) within the outer side 2 of the sleeve 1 so as to be flush with the outer surface or is configured as a contact plate 9 having an inner opening to match that of the support roll 7 and extending to the outer radius of the sleeve 1 (FIG. 6). Combinations thereof are also conceivable and will be disclosed in more detail in the following. In this way, the electrostatic charge of the printing plate or of the sleeve 1 that is generated during the printing process can be dissipated through the support roll 7 that is generally made of metal. The same holds true also for the sleeves of the other embodiments.

A sheet metal piece that is recessed into the outer side 2 of the sleeve 1 has furthermore the advantage that a charge collected across a larger area can be dissipated without greater efficiency losses faster and more safely than in the case of, for example, grounding arrangements distributed locally only at certain points.

The printing device to be used in connection with the sleeve according to the invention can also be provided with a compressed air system, known in the art, for mounting a sleeve 1. In this case, at one end of the support roll 7 a compressed air connector 11 is arranged through which the compressed air openings 12 are supplied with compressed air via the compressed air channels 13. The compressed air openings 12 are distributed on the outer side of the support roll 7 within an area of the support roll 7 that is enclosed by the sleeve 1 wherein a somewhat closer arrangement is present at that end opposite the compressed air connector 11 from where the sleeve is pushed across the support roll 7.

Instead of providing a sleeve 1 that completely encloses the corresponding areas of the support roll 7, the sleeve can also be of a multi-part configuration, for example, can be ring-shaped. Also, it is possible to design the printing plate, that is to be attached by at least one magnetic element to the sleeve, in the form of a multi-part printing plate.

As illustrated in FIG. 6, the electrically conducting element 8 of the printing device according to the invention can be either a contact ring 9 at one end of the sleeve 1 or can be in the form of an axially arranged sheet steel that is sunken or recessed into the outer side of the sleeve. Also, the sheet steel and contact ring 9 can be formed together as an electrically conducting element 8. It is then electrically conductingly connected to the support roll 7 of the printing device and to the ground of the printing device.

Figure 7:
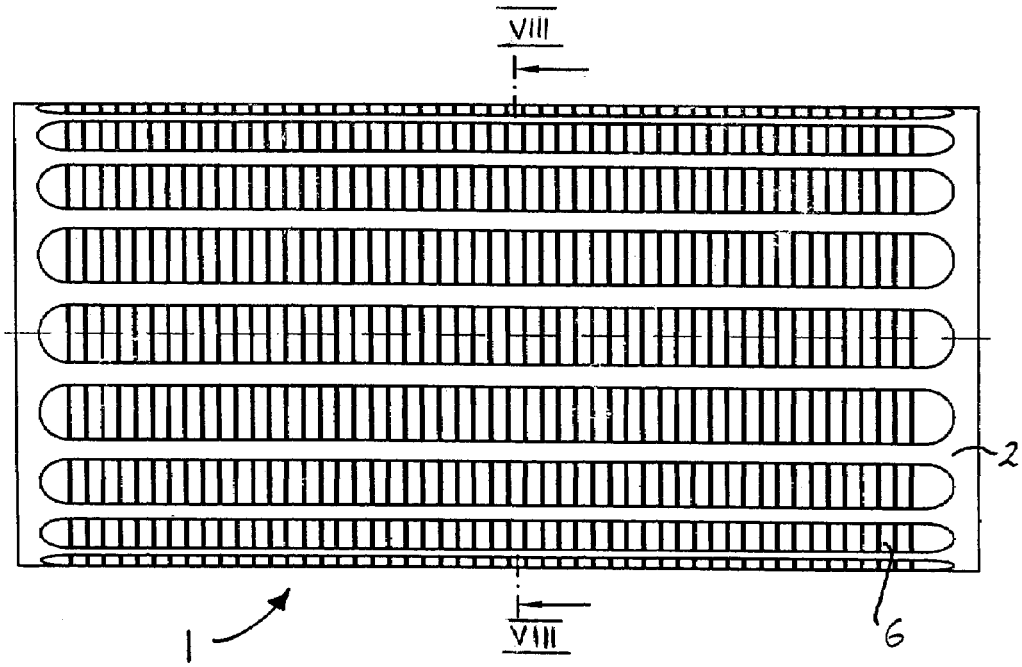
FIG. 7 shows the sleeve according to FIG. 2 in a plan view.
Figure 8:
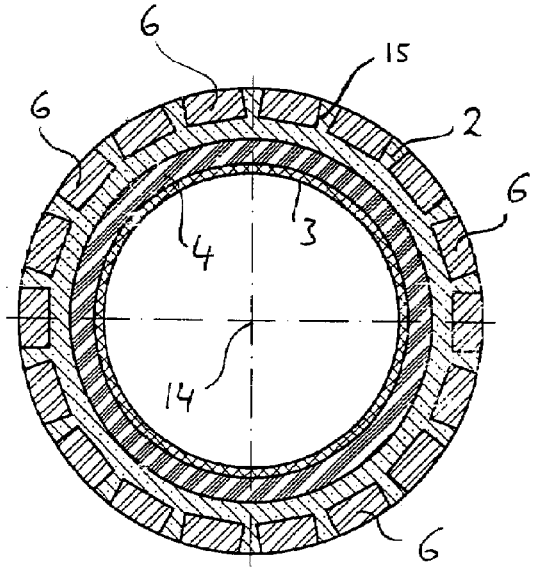
FIG. 8 is a cross-section along section line VIII-VIII of FIG. 7.

FIGS. 7 and 8 show the regular arrangement of magnetic elements 6 or magnets that are provided with paired poles (N-N, S-S) facing one another for reinforcing the magnetic effect. The magnets 6 are sunken or recessed in recesses of the outer layer 2 and extend approximately across the entire width of the sleeve 1. After the magnets 6 have been placed into the recesses, the recesses are filled with a potting compound.

Viewed from a center 14 of the sleeve 1 (FIG. 8), the outer side of the magnetic elements 6 can be matched to the curvature of the sleeve 1; alternatively or in addition, the sleeve 1 is provided at the outer side with a sealant that ensures a smooth, uniform surface and is comprised, for example, of a varnish (lacquer) or a two-component adhesive. The additional sealant enhances the exact contact of the printing plates on the sleeve 1 and prevents wear or other damage of the magnetic elements 6.

The recesses into which the magnets 6 are placed can have sidewalls 15 that are parallel to one another; into these recesses the magnets are placed that usually have an approximately rectangular cross-section. Alternatively, it is also conceivable to provide at least some of the magnetic elements 6 with sides that are sloping relative to one another so that the sloping sidewalls 15, when extended, intercept one another at a common point, for example, the center 14.

The inner layer 3 of a sleeve 1 can be comprised of fiberglass reinforced plastic material wherein the central layer 4, depending on the desired outer diameter of the sleeve 1, can be provided with varying layer thicknesses in the manufacturing process. The outer layer 2 has advantageously a thickness of at least 6.5 mm in order to ensure an optimal incorporation of the magnetic elements.

Figure 9:
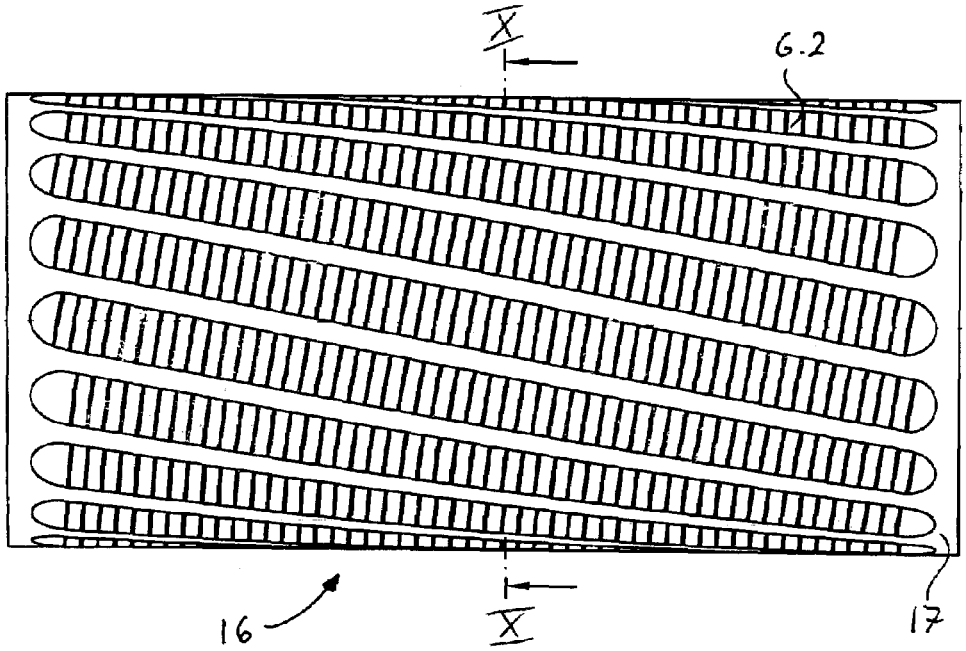
FIG. 9 is a sleeve of a further embodiment of the invention in a plan view.
Figure 10:
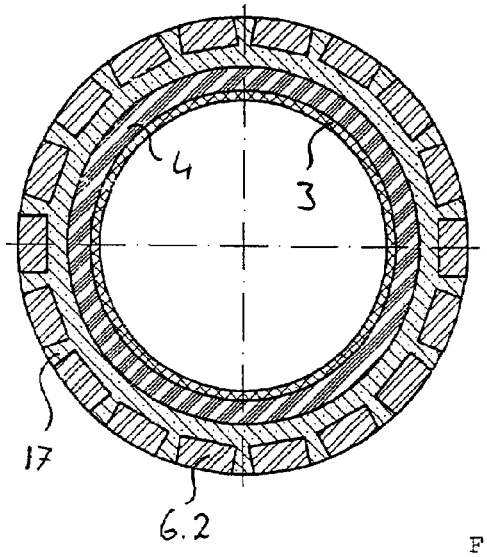
FIG. 10 shows the sleeve of FIG. 9 in a section along section line X-X

FIG. 9 shows a sleeve 16 of a further printing device according to the invention with an alternative arrangement of the magnetic elements 6.2 that are arranged on the outer side of the sleeve 16 in strips that are slanted or coiled relative to the central axis of the sleeve 16. The basic configuration with inner layer 3 of fiberglass plastic material, compressible intermediate layer 4, and outer layer 17 of the sleeve depicted in FIG. 9 is in cross-section (FIG. 10) essentially identical to the cross-sectional view of FIG. 8 of the embodiment according to FIG. 7 and FIG. 2. Minimal differences that result from the different course of the strips are not illustrated in FIG. 10.

Figure 11:
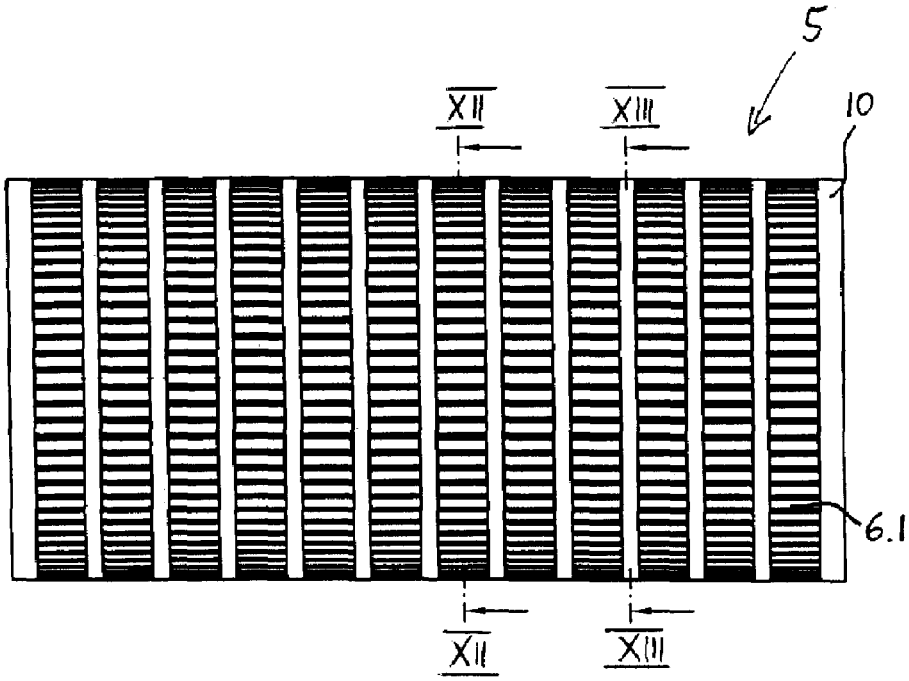
FIG. 11 shows the sleeve of FIG. 3 in a plan view.
Figure 12:
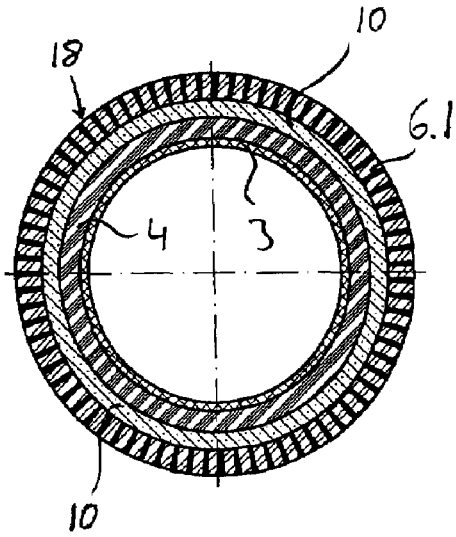
FIG. 12 shows a cross-section along section line XII-XII of FIG. 11.
Figure 13:
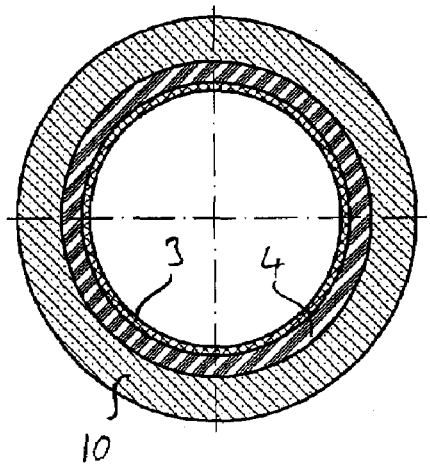
FIG. 13 shows a cross-section along section line XIII-XIII of FIG. 11.

The embodiment according to FIG. 11 is illustrated in FIGS. 12 and 13 in cross-section, respectively. The cross-section of FIG. 12 shows that the magnets 6.1 in cross-section are approximately rectangular so that the sidewalls 18 are parallel to one another. Advantageously, the space between the magnets 6.1 and/or between the magnets 6.1 and the sidewalls of the recess filled with a potting compound does not impair the penetration of magnetic flux lines so that an optimal propagation of the magnetic field is enabled. The cross-section according to FIG. 13 shows that the sleeve has substantially a configuration that is identical to that in the preceding embodiments; this is advantageous for manufacturing the sleeve 5.

A printing device employing a sleeve 1, 5, 16 according to the invention with its combination of a configuration for pneumatic threading and magnetic elements 6, 6.1, 6.2 for attachment of a magnetizeable printing plate has great advantages for flexo printing, in particular, for wide web flexo printing. The printing plates are safely and fixedly secured on the sleeves but can be exchanged quickly.

While specific embodiments of the invention have been shown and described in detail to illustrate the inventive principles, it will be understood that the invention may be embodied otherwise without departing from such principles.

What is claimed is:

1. A sleeve for a printing device, wherein the sleeve is adapted to be detachably and exchangeable mounted on a support roll and, when mounted on the support roll, surrounds at least partially the support roll; the sleeve comprising:

securing means for detachably securing on the sleeve at least one printing plate that comprises a ferromagnetic material or has at least one magnetic element;

wherein the securing means comprises at least one magnetic element for interacting with the ferromagnetic material of the at least one printing plate or the securing means is a ferromagnetic material interacting with the at least one magnetic element of the printing plate;

wherein the sleeve is adapted to be detachably and exchangeable mounted on the support roll by pneumatic threading, wherein the sleeve has at least one layer that is widened during mounting on the support roll by compressed air.

2. The sleeve according to claim 1, wherein the at least one magnetic element of the securing means is comprised of at least one permanent magnet incorporated into the sleeve for securing the at least one printing plate having a bottom that is comprised at least partially of the ferromagnetic material.

3. The sleeve according to claim 2, wherein a plurality of the at least one magnetic element are arranged on or in an outer side of the sleeve and are distributed about a circumferential outer surface of the sleeve.

4. The sleeve according to claim 1, wherein the sleeve is secured positively on the support roll.

5. The sleeve according to claim 1, comprising an electrically conducting contact element provided circumferentially on an outer side of the sleeve for dissipating electrostatic charges, wherein the electrically conducting contact element is adapted to contact conductingly the at least one printing plate and has an electric ground connection to the support roll.

6. The sleeve according to claim 5, wherein the contact element comprises a fiat metal piece recessed into the outer side of the sleeve so as to be flush with a circumferential outer surface of the sleeve.

* * * * *